United States Patent [19]

Hunt

[11] Patent Number: 4,838,294

[45] Date of Patent: Jun. 13, 1989

[54] OPENABLE ENCLOSURES AND STRUCTURES INCORPORATING SUCH ENCLOSURES

[76] Inventor: Rowland D. Hunt, 1118 Manitou Rd., Santa Barbara, Calif. 93101

[21] Appl. No.: 152,424

[22] Filed: Feb. 4, 1988

[51] Int. Cl.[4] ..... E04B 1/347

[52] U.S. Cl. ..... 135/102; 135/905; 135/106

[58] Field of Search ..... 135/101, 102, 106, 905

[56] References Cited

U.S. PATENT DOCUMENTS

| | | | |
|---|---|---|---|
| 3,802,450 | 4/1974 | Huddle | 135/102 X |
| 3,811,454 | 5/1974 | Huddle | 135/102 |
| 3,865,123 | 2/1975 | Bracken | 135/102 |
| 4,092,992 | 6/1978 | Huddle | 135/102 |
| 4,116,206 | 9/1978 | Warner | 135/102 |
| 4,583,331 | 4/1986 | Hunt et al. | 135/102 |

*Primary Examiner*—Henry E. Raduazo

[57] ABSTRACT

An openable closure, for example for entry to a building structure, has a plurality of arched frames pivotally mounted on the ground at each end, with fabric panels extending between frames. The first or outermost frame extends outwardly close to the ground, the next frame inclined upwardly at an intermediate position. The ground attachment positions of the first frame are positioned forward of and outward of the attachment positions of the next frame, with the first frame being longer than the next frame. The first frame can pivot up and over the next frame, with the fabric panel passing over the next frame. A similar arrangement can be provided for the next frame relative to a further frame, if provided.

22 Claims, 11 Drawing Sheets

OPENABLE ENCLOSURES AND STRUCTURES INCORPORATING SUCH ENCLOSURES

BACKGROUND OF THE INVENTION

1. Field of the Invention

This invention relates to openable enclosures, and also to structures incorporating such enclosures. In particular, the invention relates to structures having metal frames and inserted fabric panels.

2. Related Art

In structures such as aircraft storage hangars, storage buildings and other structures, it is often desired to provide openable structures which extend for the full width of the building. In particular, in structures having metal frames with inserted fabric panels, it is useful to have an openable enclosure comprising frames pivoted at each end at ground level which can be pivotted up to provide ingress and egress. Structures embodying such operable enclosures are described in U.S. Pat. No. 4,583,331 issued Apr. 22, 1986.

However, there is a problem with the openable structures or enclosures as described in the above-mentioned patent in that the fabric hangs downward between each adjacent pair of frames as the frames are pivotted upward. This restricts the headroom through the opened enclosure.

SUMMARY OF THE INVENTION

In the present invention, the frames are arranged such that the frame nearer to the ground is made larger than the next frame and is pivotted at ground level at a position outward and forward of that of the next frame.

Conveniently, each frame is composed of straight portions joined by curved sections. In particular, each frame has straight wall portions. The wall portions join to straight roof portions inclined upwardly and inwardly. The roof portions are joined at the top by a curved section and the wall portions are joined to the roof portions by curved sections. The straight portions each comprise one or more straight sections joined together. By varying the number of straight sections joined together, the length of a straight portion can be varied.

Normally, an openable enclosure comprises a minimum of two frames referred to for convenience as front and intermediate frames. The front frame is close to the ground when the enclosure is closed, and the intermediate frame is at some position or angle above the front frame. The front frame is provided with longer straight portions than the intermediate frame. There is provided for the front frame a pivotal position outside of and forward of the pivotal position of the intermediate frame and the front frame can therefore pivot up and over the intermediate frame, pulling the fabric panel back over the intermediate frame also. This avoids any fabric hanging down. If desired, a further frame rearward of the intermediate frame can be provided, the intermediate frame provided with longer straight portions than the rearward frame and pivotal positions outside of and forward of the pivot positions of the rearward frame. The intermediate frame can then pivot up and over the rear frame. The longer straight portions can be the wall portions, or the roof portions, or a combination of both.

Thus, broadly, in accordance with the invention, an openable enclosure has a plurality of spaced apart frames, with at least one frame pivoting from a ground position forward of and outside of the next rearward frame. Each frame has a straight wall portion at each side and a straight roof portion each side, the portion joined by curved sections. At least a straight portion on each side of the frame to be pivotted up is larger than the corresponding portion on the next rearward frame.

BRIEF DESCRIPTION OF THE DRAWINGS

The invention will be readily understood by the following description of certain embodiments, by way of example, in conjunction with the accompanying drawings, in which.

DETAILED DESCRIPTION OF THE EMBODIMENTS

Figure 1:
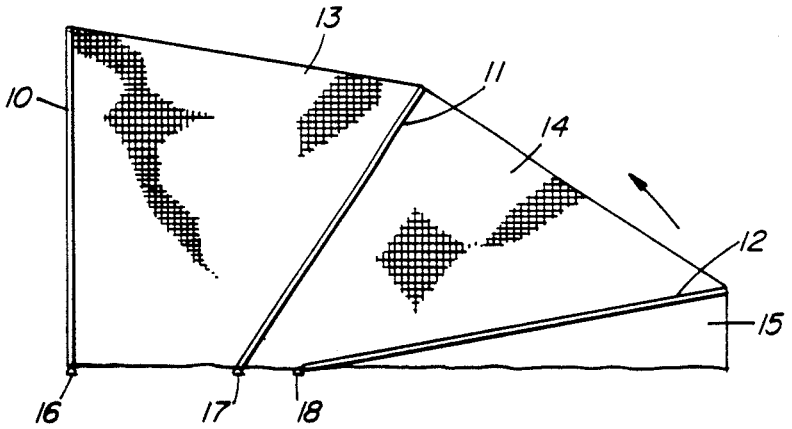
FIG. 1 is a side view of an enclosure with three frames, the lower one pivotting up over the next frame, the enclosure being closed.

As illustrated in FIG. 1, an enclosure comprises three arched frames 10, 11 and 12, frame 10 being referred to as a rear frame, frame 11 as an intermediate frame, and frame 12 as a front frame. The frames are shown in full for clarity but in use, when erected, fabric panels 13 and 14 extend between frames 10 and 11, and 11 and 12 while a further panel 15 extends down from frame 12 to the ground. Frames 10, 11 and 12 are pivotally attached to ground plates or anchors at 16, 17 and 18. In FIG. 1, the enclosure is shown closed, with the front frame 12 near the ground. Frame 10 is vertical and frame 11 extends at an angle, between frames 10 and 12. The ground plate or anchor 18 is positioned forward of and outside of the ground plate or anchor 17.

Figure 2:
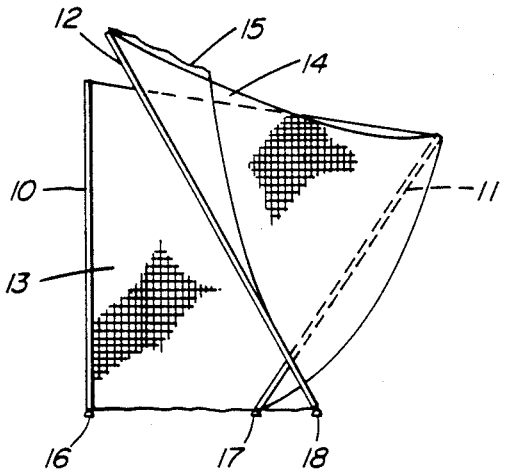
FIG. 2 is a side view of the enclosure of FIG. 1 opened.

FIG. 2 illustrates the enclosure of FIG. 1 with the front frame 12 pivotted up and over the intermediate frame 11. The panel 14 is also pulled over the frame 11 and thus there is complete unobstructed clearance up to the height of the middle frame 11.

Figure 3:
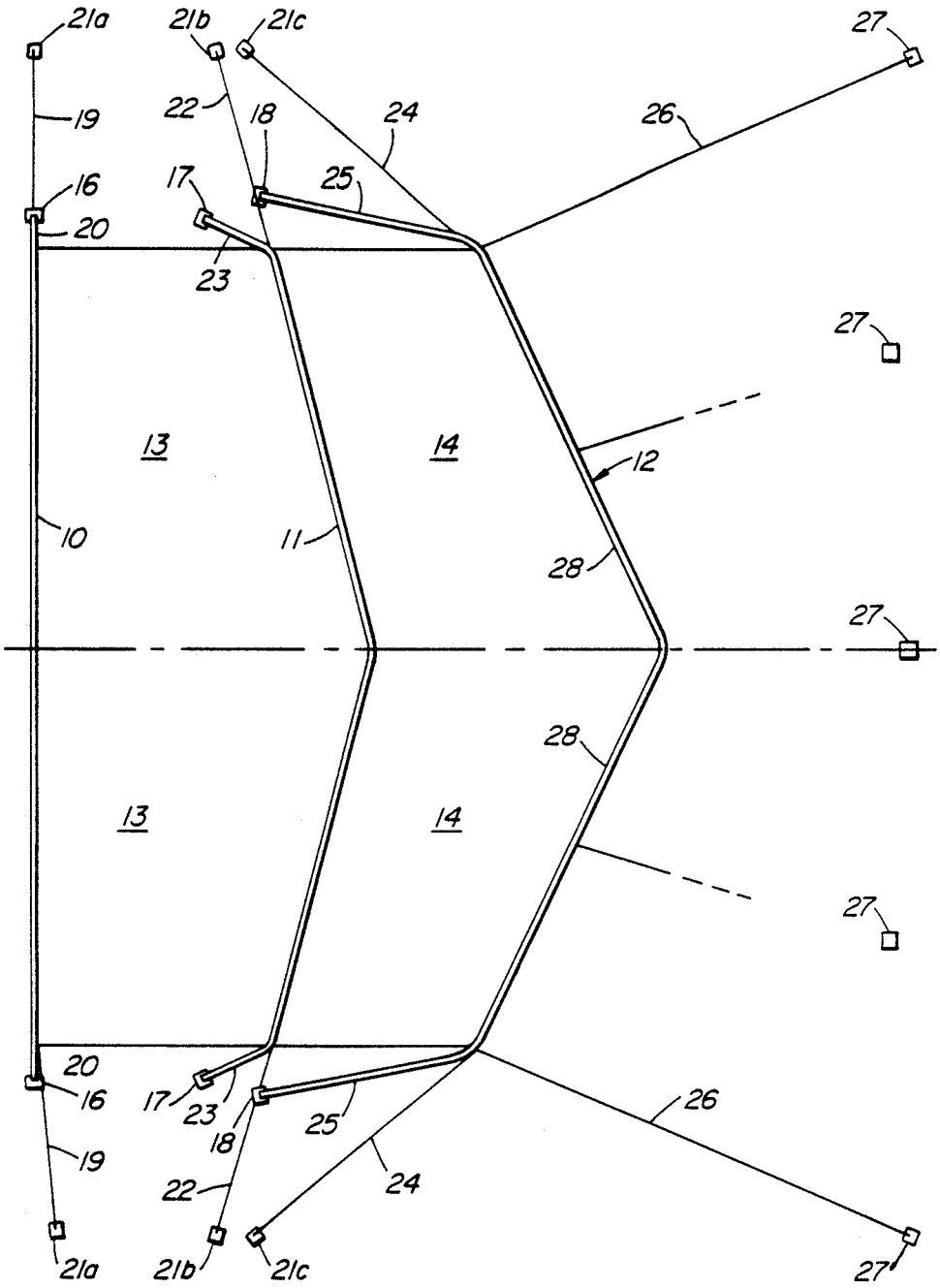
FIG. 3 is a top plan view of the enclosure closed as in FIG. 1, fabric omitted for clarity.
Figure 4:
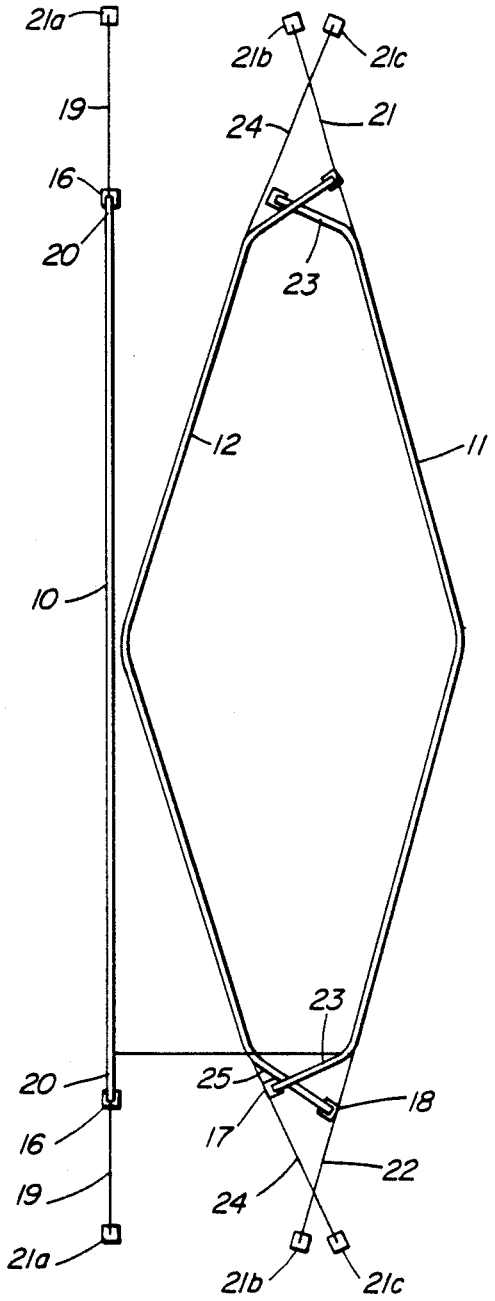
FIG. 4 is a top plan view of the enclosure open as in FIG. 2.

FIG. 3 is a plan view of the enclosure of FIGS. 1 and 2, in the closed condition as in FIG. 1. The frames are shown in full for clarity. For stability, for example against storms, ties can extend between frames and ground anchors, one arrangement being seen in FIG. 3. Ties 19 go from the top of the wall portions 20 of frame 10 to anchors 21*a*. Ties 22 go from the top of the wall portions 23 of frame 11 to anchors 21*b*. Ties 24 go from the tops of the wall portions 25 of frame 12 to anchors 21*c*. Ties 26 also go from the tops of the wall portions 25 of frame 12 to ground anchors 27. The number of ties 26 required can vary, particularly depending upon the span of the frames. Ties 26 are released when it is desired to lift frame 12, while ties 24 need not be released if suitably positioned. FIG. 4 shows the front frame 12 pivotted up and over frame 11. In both FIGS. 3 and 4, it can be seen that the ground plates 18 for the front frame 12 are outside of the lines through the ground plates 16 and 17. This can be obtained by making the wall portions 25 larger than wall portions 23, as shown in FIGS. 3 and 4. However, the roof portions 28 of frame 12 can be made longer than the roof portions of frame 11 and gives the same result. Thus, the frame 12 can pass over frame 11 and the panel 14 is wrapped over frame 11 also and lies more or less on panel 13. The panel 15 (FIG. 1) rests back over the outside of panel 14.

The structure illustrated in FIGS. 3 and 4 have inclined walls portions 23, 24 and 25, but the wall portions could be vertical. Conveniently, in FIGS. 3 and 4 the wall portions 25 are made longer than portions 23 and this provides for the outward spacing of anchor 18 and also the additional height for frame 12 to move over frame 11. In an alternative, the wall portions 25 can be the same length as portions 23 and roof portions of frame 12 made longer than the roof portions of frame 11. If the walls are substantially vertical, then the outward positioning of the pivot points, anchors 18, can be obtained by making the roof portions longer.

Figure 5:
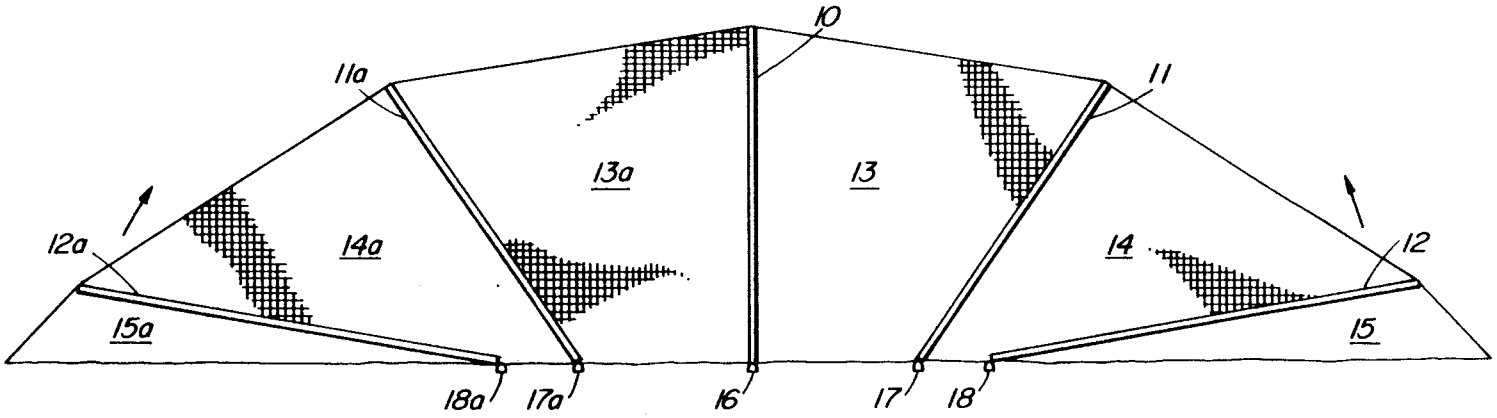
FIG. 5 is a side view of a structure composed of two enclosures as in FIG. 1, back-to-back, in a closed condition.
Figure 6:
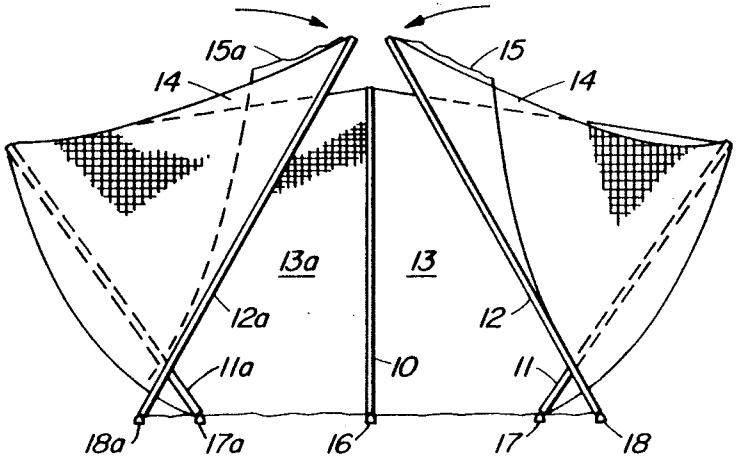
FIG. 6 is a side view of the structure as in FIG. 5, in an open condition.

FIGS. 5 and 6 illustrate a structure, such as could be used as an enclosure for aircraft or other vehicles. It comprises two enclosures as in FIGS. 1 to 4 back-to-back. Corresponding reference numerals have been used for items common with FIGS. 1 to 4, with the items on the left hand side having "a" added to the reference numerals. In this example, the end panel 15 extends outward to generally follow the profile of panels 13 and 14. Panel 15*a* generally follows the profile of panels 13*a* and 14*a*. Both ends can be opened, as shown in FIG. 6. This enables vehicles and the like to pass through the enclosure, or enter or leave from either end. Only one end need be opened if that is all that is desired, or necessary.

Figure 7:
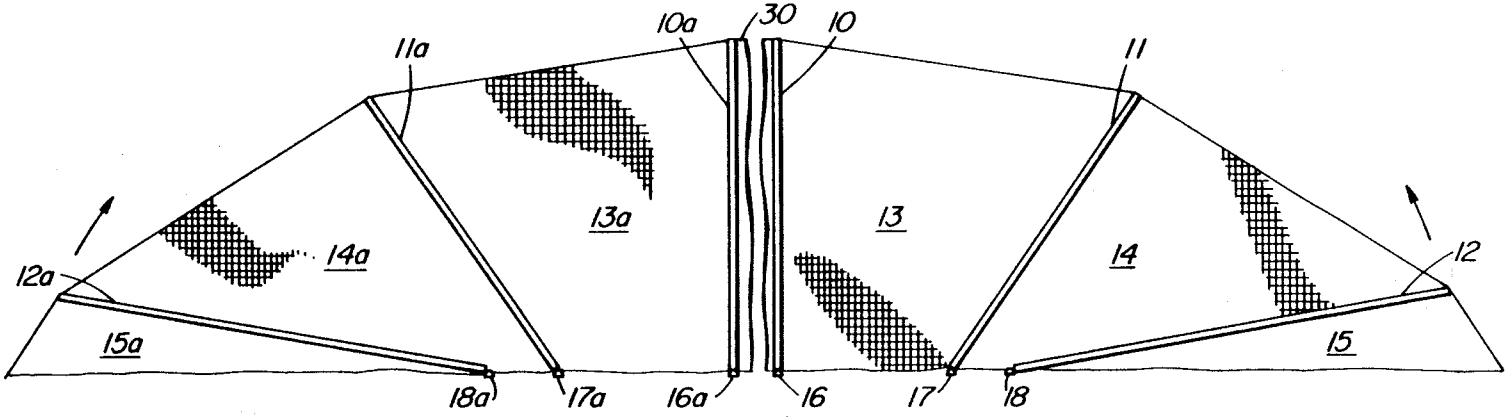
FIG. 7 is a side view of a structure composed of two enclosures as in FIG. 1, an enclosure at each end of a structure having a center section of constant shape.
Figure 8:
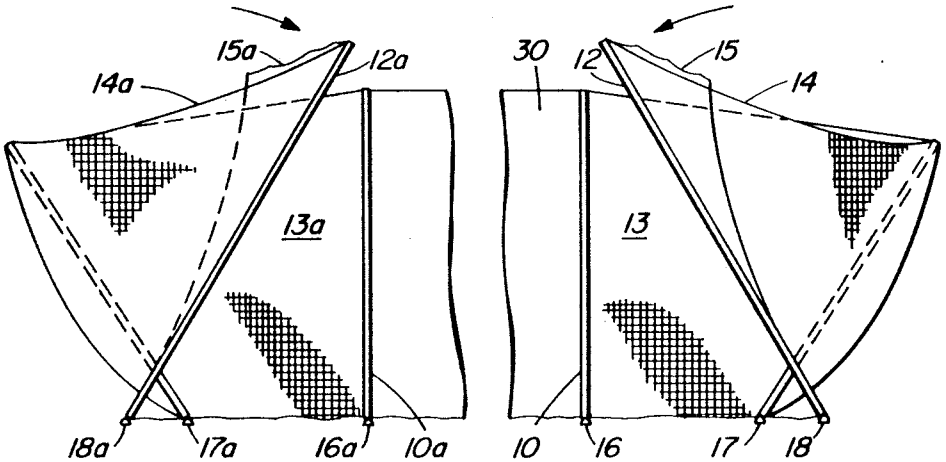
FIG. 8 is a side view of the structure of FIG. 7 in an open condition at both ends.

The operable closures can also be used on one end or both ends of a building having a normal, constant shape or cross-section. Such an arrangement is illustrated in FIGS. 7 and 8, FIG. 7 showing both ends closed and FIG. 8 showing both ends open. The center portion 30 can be of the form as described in the above-mentioned U.S. Pat. No. 4,583,331, with spaced frames and fabric panels, the panels being tensioned, after installation, by inflatable tubes in the panels for example. Common reference numerals are used in FIGS. 7 and 8 as are used for the same items in FIGS. 5 and 6.

Figure 9:
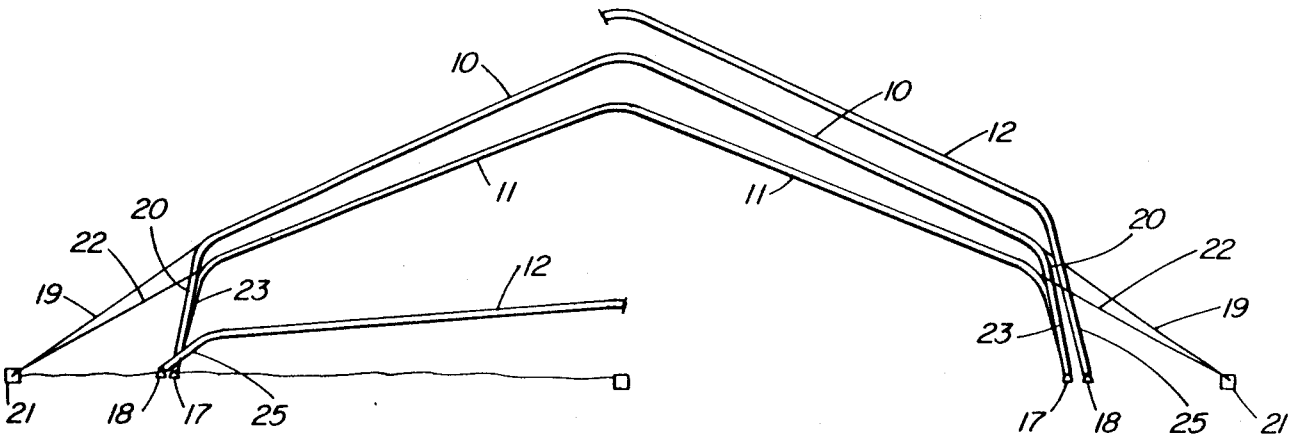
FIG. 9 is an end view of an enclosure as in FIGS. 1 and 2, the left half showing the closed condition and the right half the open condition.

FIG. 9 is an end view on an enclosure showing it in a closed condition on the left and in an opened condition on the right. This view would be common to all of the operable enclosures as shown in FIGS. 1 to 8. It can be seen how the extra length of the wall portion 25 of frame 12 enables the frame to swing up and over the frame 11.

Figure 10:
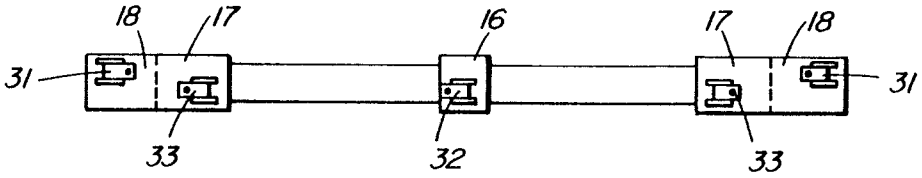
FIG. 10 is a plan view of a ground pivot arrangement for each side of a structure as in FIGS. 5 and 6.

FIG. 10 illustrates ground plates, or anchors as used for each side. In the example illustrated, which is for the arrangement illustrated in FIGS. 5 and 6, five ground plates are provided each side. For convenience, the ground plates at each end are combined into a single plate, in the example. The reference numerals are as those in FIGS. 5 and 6. A set of ground plates is provided each side, one set rotated relative to the other so that the positions of the pivots 31 on ground plates 18 are outside of the pivots 32 and 33 for ground plates 16 and 17 respectively.

Figure 11:
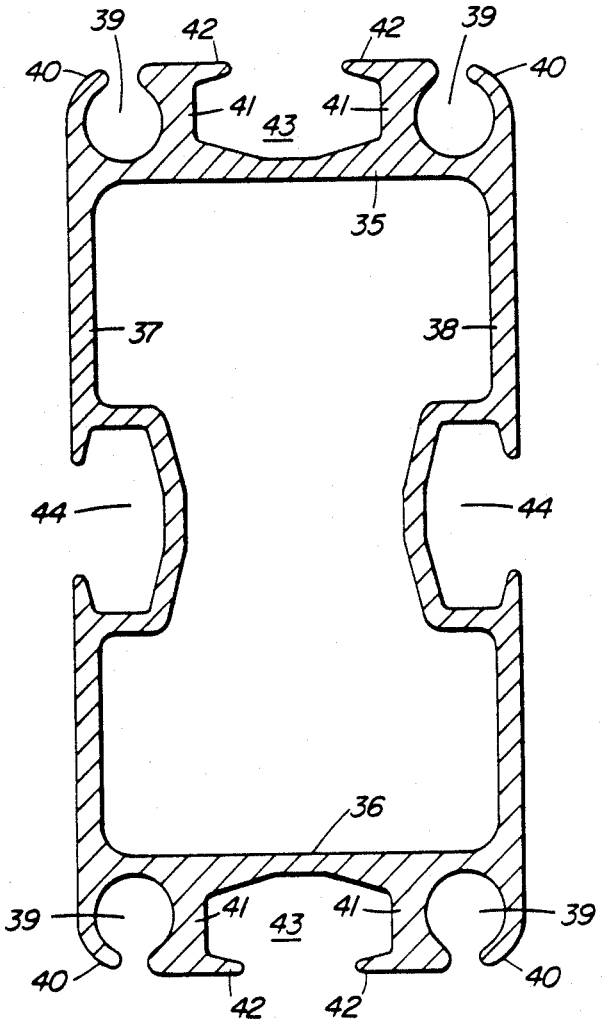
FIG. 11 is a cross-section through a frame.

FIG. 11 illustrates one particular cross-section as used for the sections of the frames. Both the straight sections and the curved sections have the same cross-section. The section is a hollow box section—conveniently extruded. The section has outer and inner flanges 35 and 36, connected by side walls 37 and 38. On each flange at the outer corner is formed a slot 39 having a keyhole section, defined by outer walls 40 and inner walls 41. The inner walls 41 have inwardly projecting ribs 42, the walls 41 and ribs 42 defining two further slots 43. In each side wall is formed a slot 44, in the example having the same cross-section as slots 43.

Figure 12:
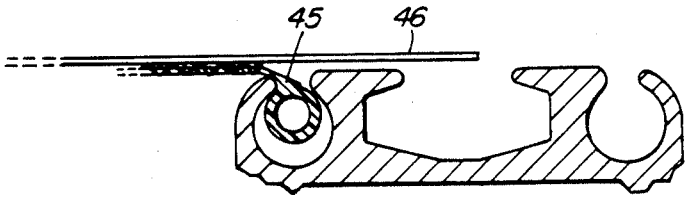
FIG. 12 is a part section of a frame as in FIG. 11, showing the attachment of a fabric panel edge to the frame.

FIG. 12 illustrates a method of attaching fabric panels. A panel has an edge 45 which is enlarged similar to the roped edge used on sails. The enlarged edge slides in the slot 39, extending out of the slot. The panel can be given a flap 46 which extends over the outer surface of the frame. A further panel can be installed in the other slot 39 at the outer flange. Slots 39 at the inner flange can be used to install further panels, for decoration, screening, insulation and other purposes.

Figure 13:
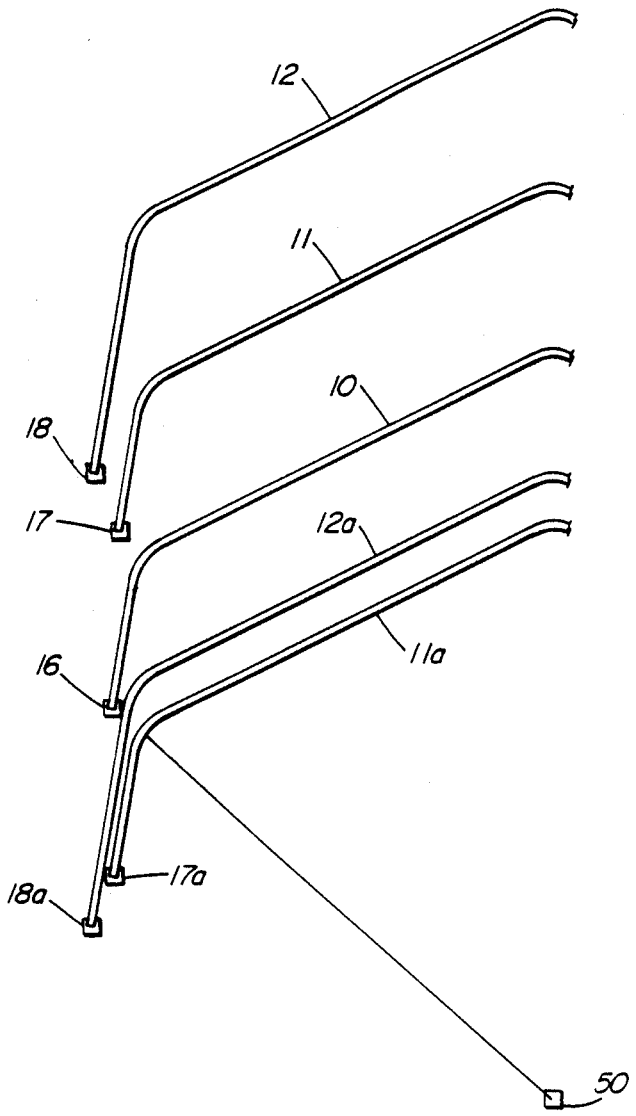
FIG. 13 is a plan view of the frames attached to the ground plates and resting on the ground prior to erection, for a structure as in FIGS. 5 and 6.

FIG. 13 illustrates, in plan form, the preliminary positioning of frames prior to erection into an enclosure as in FIGS. 5 and 6. The reference numerals are as in FIGS. 5 and 6. It will be seen that the outermost or front frame 12*a* in FIG. 5 is capable of being placed on the ground between frames 10 and 11a because it is larger. The outwardly spaced positions of ground plates 18 and 18a are relative to ground plates 16, 17 and 17a.

With inclined wall portions of the frames, as illustrated, the front frame 12*a* can readily be made longer by making the wall portions longer and the inclination of the walls results in both the ground plate or pivot position 18a being outside of the ground plate 17*a* and also ensures that the frame 12*a* is clear of the other frames when assembled on the ground. If vertical walls are provided, it is necessary that the roof portions of frame 12*a* be longer in order for the ground plate 17*a* to be outward of groud plate 17*a*. However, even so, some interference with other frames may occur and frame 12*a* may have to be supported slightly off the ground, or be allowed to rest on another frame.

To erect the structure from the preliminary assembly in FIG. 13, frame 12*a* is lifted up off the ground, for example by manually lifting, and supported at a convenient height, say about 6 feet. The edge of the panel is inserted in the outer slot (slot 39 in FIG. 11) which is closest to the ground, i.e. on the right hand or lower side as in FIG. 13. The other edge of the panel is simultaneously inserted in the upper outer slot in the frame 11*a*.

The rest of the panels are also inserted, this being eased by forming the panel edge receiving grooves in the outer surfaces of the frames. The panels can be inserted while the remaining frame or frames rest on the ground. Alternatively, each frame can be propped up by a small amount to ease access to the grooves.

Frame 12*a* is then pulled further up, as by pulling on a cable attached to the frame and passing over a king post, indicated at 50. As the panel tightens, continued lifting of frame 12*a* then lifts frame 11*a*. Once frame 11*a* is part vertical it will pivot over and down, with frame 11*a* moving up until the second panel tightens and then starts to lift frame 10. The sequence of frames lifting continues until frame 10 is vertical. Panels can then be inserted in the slots in frames 12 and 12*a*, corresponding to panels 15 and 15a in FIGS. 5 and 6. As a further alternative, panels can be installed sequentially as a further frame lifts. Thus as frame 11*a* lifts, panel 14 can be installed, and so on for any further frames.

Depending upon use of the structure, the panels 15 and 15*a* can be vertical, or extend outward generally following the roof profile. Also, the panels 13 and 14 in FIGS. 1 and 2, and panels 13, 13*a*, 14 and 14*a* in FIGS. 5 and 6 and FIGS. 7 and 8 can extend downwardly at the walls, extending between the wall portions of the frames. Alternately, the panel edges at the walls need not be inserted in the slots but can extend outwards to reduce wind loads, for example.

A somewhat similar sequence of lifting and inserting panels is used for the enclosure as illustrated in FIGS. 1 and 2, although only three frames will be pulled up. In this arrangement the panels are inserted separately, that is, after lifting up frame 12, panel 14 is inserted. Then, as further pivotting of frame 12 occurs and frame 11 is pulled up, panel 13 is inserted. For a structure as in FIGS. 7 and 8, the end closures can each be pulled up separately, or be part of the pulling up of the entire building. This latter will depend upon the size of the building. For a long center section it is likely that each half of the center section will be pulled up towards the middle, and the end frames can be included.

Figure 14:
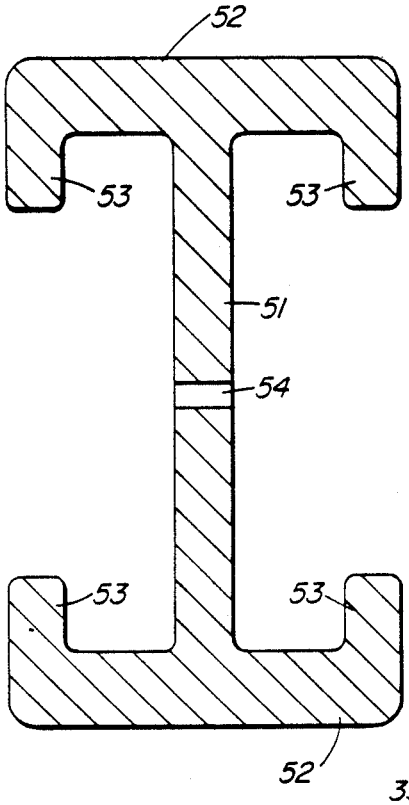
FIG. 14 is a cross-section through an insert for the frames at joints between sections.

As previously stated, the straight portions of each frame, that is, the wall portions and the roof portions, are made up of separate straight sections joined together. Conveniently, the sections are all the same length and cross-section, although this is not necessary, and the size of the building height and space - can be varied by the number of sections in a wall or roof portion. The sections are joined by inserts which extend into the adjacent ends of two sections. An insert is shown in cross-section in FIG. 14, being generally in the form of an I beam with a central web 51 and inner and outer flanges 52. The outer edges of the flanges have short ribs 53 extending towards each other parallel to the web 51. A spring clip is attached to the insert on each side of the web 51. The clip can be attached by rivetting, via holes in the web 51, one being shown at 54 in FIG. 14.

Figure 15:
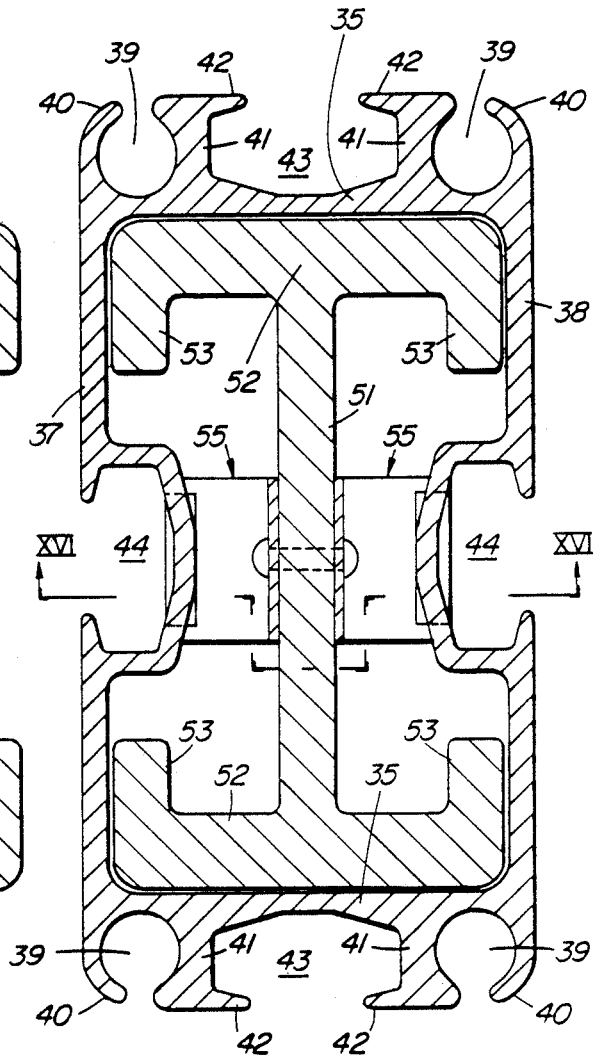
FIG. 15 is a cross-section through a frame and insert with a spring retaining member as used at joints, on the line XV—XV in FIG. 16.
Figure 16:
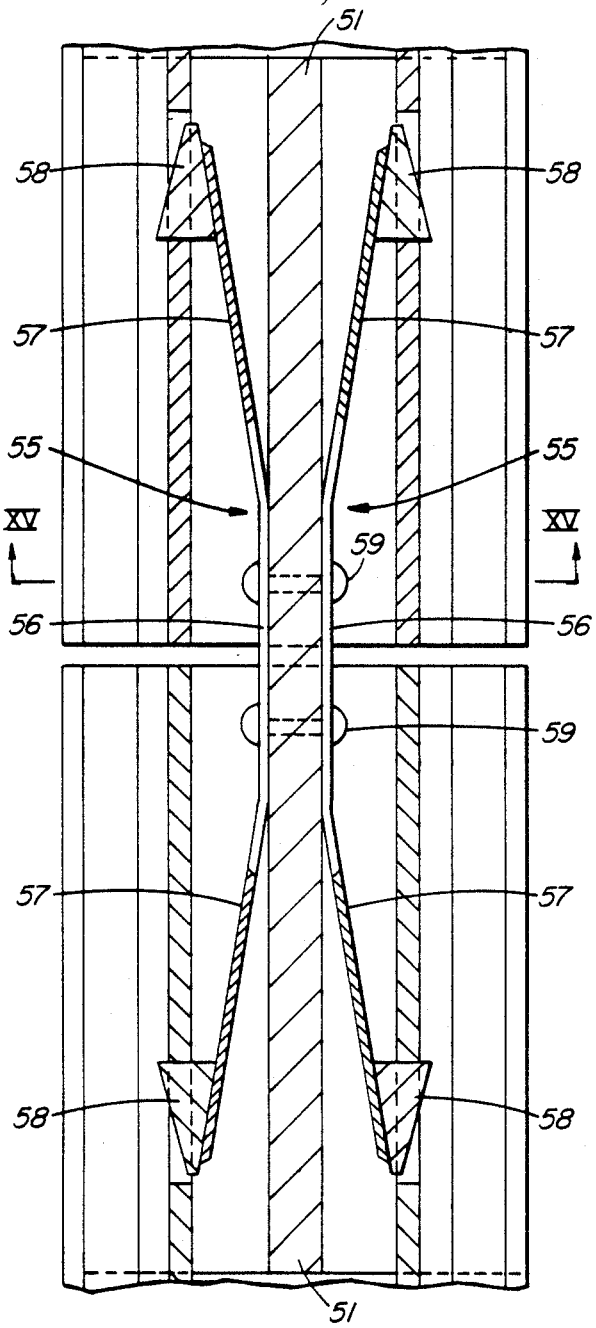
FIG. 16 is a cross-section through frames and insert in a plane normal to a joint, on the line XVI—XVI in FIG. 15.

FIGS. 15 and 16 illustrate a joint between two sections, showing an insert and spring retaining members, indicated generally at 55. As seen more clearly in FIG. 16, and also in FIG. 17 which is a plan view of a spring retaining member, a retaining member comprises a strip of spring material, for example stainless steel. The strip has a flat center portion 56 and spring cantilever legs 57 inclined up out of the plane of the center portion 56. At the end of each leg 57 is a button 58 having a tapered cross-section as viewed from the side—as illustrated in FIG. 16. A retaining member is attached on each side of the central web 51 by rivits 59, which pass through the holes 54. When the insert is slid into one end of a section, the spring cantilever legs are depressed and slide along behind the slot 44 (FIG. 11) in the section. When the insert is approximately half way in, the raised ends of the legs snap into an aperture in the inner wall of each of the slots 44. This is illustrated in FIGS. 15 and 16. The joint can be released by pushing on the buttons 58 on the legs 57 to release a section.

Figure 17:
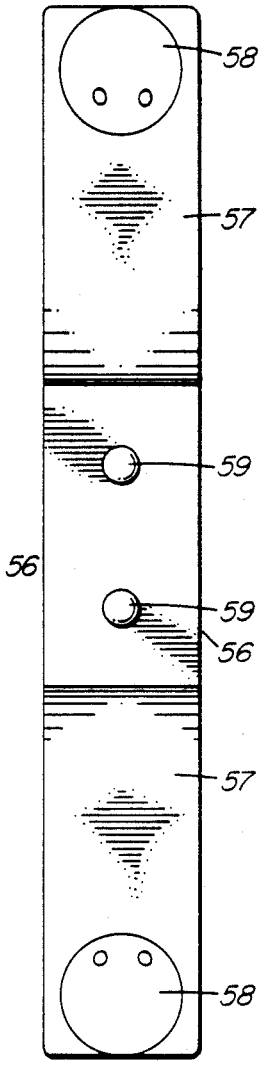
FIG. 17 is a plan view of the spring retaining member.

The joining of sections, as described above in conjunction with FIGS. 14, 15, 16, 17 and 18 can also be used to join straight sections to curved sections. Each curved section has a short straight portion at each end, at least sufficient to accept an insert, as shown in FIGS. 17 and 18.

The slots 43 and 44 have useful functions. It is possible to attach various items to the frames by sliding a bolt having a rectangular head along a slot 44. The bolt head fits in the slot 44 and can have a form which matches the form of the slot. Various fastenings can be attached to the bolts. Alternatively, shaped nuts can be slid along the slots 44 and threaded devices screwed to them. Other items, such as power cables etc., can be positioned in the slots 44 and caps can be snapped over the slots to close them. However, slots 44 need not be provided and the side walls 38 of the cross-section can be flush or level. In this case, apertures would be formed in the side walls to receive the buttons 58. The legs 57 would extend at a greater angle to engage with the side walls.

Similarly, items can be attached to the slots 43. Conveniently, a cap member can be snapped into the outer slot 43, holding down the overlapping edges or flaps of the panels. Lifting apparatus, lights or other devices can be suspended from the frames, by sliding bolts, or nuts, along the inner slot 43.

Figure 18:
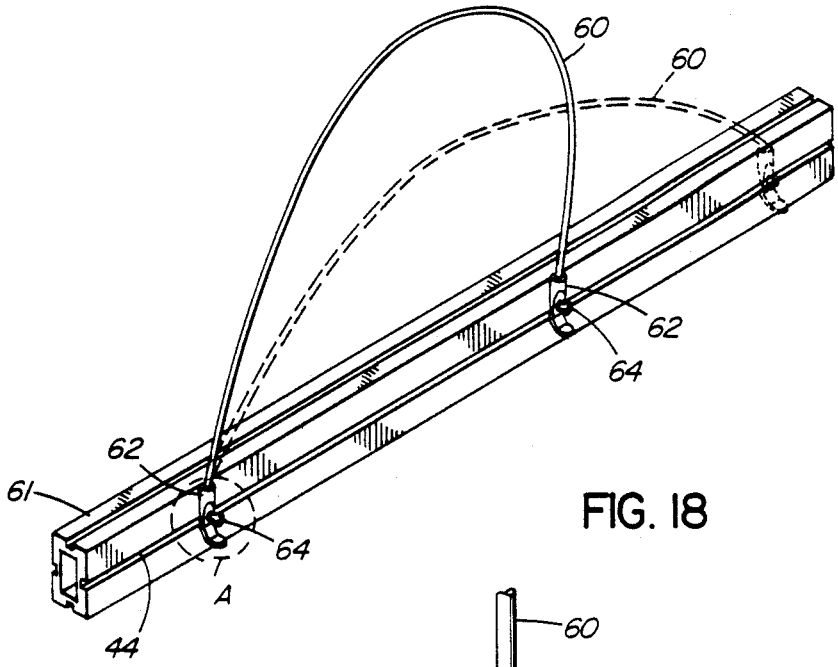
FIG. 18 illustrates the attachment of a standoff member to a frame.
Figure 19:
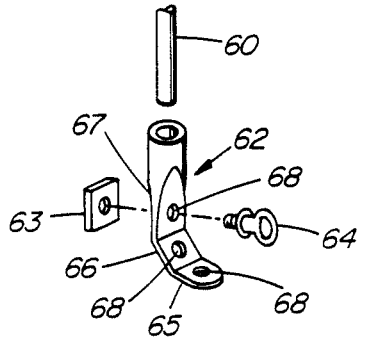
FIG. 19 is an exploded view of one bracket and associated parts, to a larger scale, as in the circle A in FIG. 18.
Figure 20:
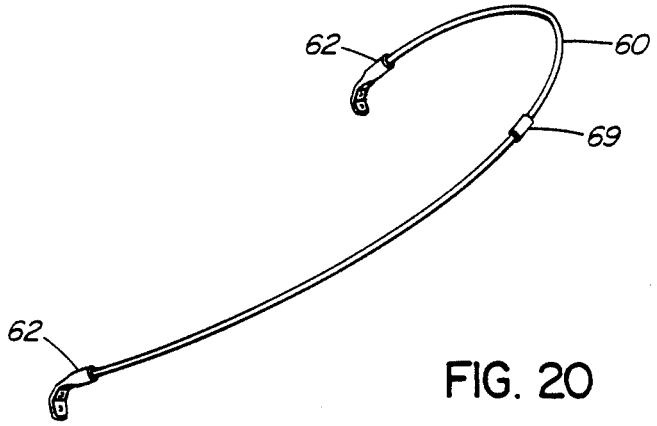
FIG. 20 illustrates an assembled standoff member and brackets.

An example of an item attached to frames using slots 44 is illustrated in FIG. 18. It can be desirable, for various reasons, that the relatively smooth peripheral profile of the building or structure be broken up. As illustrated in FIG. 19, a flexible rod 60 is attached to a frame 61 by means of brackets 62 which are mounted on a frame by use of a nut 63 which is slid into a slot 44 and a bolt 64 which screws into the nut. In the example, the brackets 62 have three portions 65, 66 and 67 angled relative to each other, each portion having a hole 68. This is seen clearly in FIG. 19. Depending upon which hole the bolts 64 are inserted through, the brackets will cause the rod to extend at different angles relative to the plane of the frame. Thus, as an example, the rod can extend at 0°, 30° and 45° to the plane of the frame. The amount by which the rod extends above the frame can be varied by sliding a nut and bolt along slot 44, as shown in dotted outline in FIG. 18. The length of the rod can be varied by joining together individual lengths. In FIG. 20, a joint is shown at 69.

What is claimed is:

1. An openable enclosure comprising:

a plurality of arched frames spaced apart and including a forward frame and an intermediate frame;

each frame comprising opposed straight wall portions and opposed straight roof portions, each portion comprising at least one straight section, the wall portions each connected at an upper end to a lower end of a roof portion, the roof portions being connected together at their upper ends;

at least one of said wall portions and said roof portions on each side of said forward frame being longer than the corresponding portions of said intermediate frame;

a fabric panel extending between each adjacent pair of frames;

ground anchorage means at a lower end of each wall portion and including pivotal means for pivotting of each frame at said ground anchorage means, the ground anchorage means being spaced forward of and outward of said ground anchorage means for said intermediate frame;

whereby said forward frame can pivot up and over said intermediate frame and the panel between the forward and intermediate frames can pass over said intermediate frame.

2. An enclosure as claimed in claim 1, having three frames, a forward frame, an intermediate frame and a rear frame.

3. An enclosure as claimed in claim 1, wherein said opposed wall portions of each frame are inclined upwardly and inwardly.

4. An enclosure as claimed in claim 3, wherein wall portions of said forward frame are longer than said wall portions of said intermediate frame.

5. An enclosure as claimed in claim 1, wherein said forward frame extends forwardly and upwardly from said ground anchorage means, and a further fabric panel on said forward frame, said further panel extending down from said forward frame to ground, said further panel resting on said panel extending between said forward frame and said intermediate panel, when said forward frame is pivotted up and over said intermediate panel.

6. An enclosure as claimed in claim 3, wherein said forward frame extends forwardly and upwardly, said rear frame extends substantially vertically, and said intermediate frame extends at an angle intermediate the forward frame and the rear frame.

7. An openable structure having an openable enclosure at each end, each openable enclosure comprising:

a plurality of arched frames spaced apart and including a forward frame and an intermediate frame;

each frame comprising opposed straight wall portions and opposed straight roof portions, each portion comprising at least one straight section, the wall portions each connected at an upper end to a lower end of a roof portion, the roof portions being connected together at their upper ends;

at least one of said wall portions and said roof portions on each side of said forward frame being longer than the corresponding portions of said intermediate frame;

a fabric panel extending between each adjacent pair of frames;

ground anchorage means at a lower end of each wall portion and including pivotal means for pivotting of each frame at said ground anchorage means, the ground anchorage means being spaced forward of and outward of said ground anchorage means for said intermediate frame;

whereby said forward frame can pivot up and over said intermediate frame and the panel between the forward the intermediate frames can pass over said intermediate frame.

8. A structure as claimed in claim 7, comprising a rear frame common to each enclosure, each enclosure further comprising a forward frame and an intermediate frame.

9. A structure as claimed in claim 7, comprising a plurality of substantially vertical frames spaced apart a predetermined distance and including a fabric panel between each adjacent pair of frames, said panels including tensioning means for tensioning said panels after installation, said openable enclosure at each end including a rear frame, said rear frame being composed of an end one of said plurality of substantially vertical frames.

10. An enclosure as claimed in claim 1, said wall portions connected to the roof portions and said roof portions connected to each other by curved sections.

11. An enclosure as claimed in claim 10, wherein said sections forming said wall portions and said roof portions and said curved sections are of hollow-box cross-section comprising outer and inner flanges, and side walls connecting said outer and inner flanges at outer edges thereof.

12. An enclosure as claimed in claim 11, including a slot formed in an outer surface of each flange at each outer edge of said flanges, each said slot having a keyhole section.

13. An enclosure as claimed in claim 12, including a further slot in the outer surface of each flange, extending between said slots at each outer edge, each said further slot including opposed inwardly extending ribs at its outer edges.

14. An enclosure as claimed in claim 13, including an additional slot in the outer surface of each side wall at a position intermediate said flanges, each said additional slot including opposed ribs extending towards each other at the outer surface.

15. An enclosure as claimed in claim 11, wherein said sections are connected together by inserts, each insert including spring retaining means.

16. An enclosure as claimed in claim 15, each said insert comprising a beam having a central web and inner and outer flanges extending on either side of said central web, said beam being a sliding fit into said hollow box cross-section of said sections.

17. An enclosure as claimed in claim 16, said spring retaining means comprising a spring retaining member on each side of each central web, each retaining member having a central portion attached to said central web and opposed spring cantilever legs extending either side of said central portion and inclined away from said central web, and a protrusion at the outer end of each cantilever leg, whereby the beam extends across the joint between two sections, the protrusions at one end of each retaining member engaging in apertures in one section and the protrusions at the other end of each retaining member engaging in apertures in the other section.

18. An enclosure as claimed in claim 1, including a projecting member attached to at least one frame.

19. An enclosure as claimed in claim 14, including a projecting member attached to a frame in said additional slot and extending beyond the periperhy of a frame, the position of said projecting member being variable.

20. An enclosure as claimed in claim 19, the extension of the projecting member being variable.

21. An enclosure as claimed in claim 19, the angle of projection of the projecting member being variable.

22. An enclosure as claimed in claim 1, including stabilizing ties extending from said frames to further ground anchoring means.

* * * * *